United States Patent [19]

Bowman

[11] 4,078,460

[45] Mar. 14, 1978

[54] TIMBER MILLING APPARATUS

[75] Inventor: John Harvey Bowman, Wodonga, Australia

[73] Assignee: Portable Electric Saw Mills Proprietary Limited, Wodonga, Australia

[21] Appl. No.: 734,096

[22] Filed: Oct. 20, 1976

[30] Foreign Application Priority Data

Oct. 22, 1975 Australia ..... 3684/75

[51] Int. Cl.[2] ..... B27B 7/02

[52] U.S. Cl. ..... 83/5; 83/488; 83/471.2

[58] Field of Search ..... 83/5, 486, 488, 485, 83/471.2, 471.1, 471.3, 489

[56] References Cited

U.S. PATENT DOCUMENTS

| | | | |
|---|---|---|---|
| 683,590 | 10/1901 | Brower | 83/488 |
| 2,669,262 | 2/1954 | Stevens | 83/488 |
| 2,800,932 | 7/1957 | Scott | 83/5 |

*Primary Examiner*—Donald R. Schran
*Attorney, Agent, or Firm*—Fleit & Jacobson

[57] ABSTRACT

A portable timber milling apparatus comprising a wheeled, mobile platform with a power generator set located on one end thereof. The platform carries a longitudinally extending beam supported adjacent each end for transverse movement by transverse beam support members which are engaged with posts located on each side of the platform. The posts carry elevating means for vertical movement of the members and the beam. A carriage mounted on wheels for movement along the beam, the carriage having vertical and horizontal saw blades each driven by separate electric motors. A further electric drive motor is provided to move the carriage along the beam. A plurality of log traversing chains are mounted on the platform and are operable to move a log thereof to a position centrally of the platform and aligned with the beam.

8 Claims, 6 Drawing Figures

TIMBER MILLING APPARATUS

BACKGROUND OF THE INVENTION

This invention relates to improvements in timber milling apparatus and relates particularly to a portable timber milling jig which can be positioned at any desired location, preferably in the forest where the timber for milling is felled.

It has previously been proposed to provide a portable timber mill comprising two pairs of stands erected on concrete slabs poured on the mill site. The pairs of stands support a beam and a carriage is mounted for movement along the beam. The carriage has driving means for two saw blades mounted at right angles to each other. The drive means consists of an internal combustion engine which drives both the saw blades through suitable gear box means. The beam is movable both vertically and horizontally to move the carriage over a log positioned therebelow to thereby cut timber from the log.

While such portable timber milling apparatus is extremely useful in sawing large logs into timber lengths, the operation of the apparatus is relatively time consuming. Substantial time is also required for erection of the apparatus in the forest.

In another form of portable saw milling apparatus, the driving means for two perpendicular saw blades is fixed in a frame and the log to be sawn is carried passed the saw blades on a movable carriage. The whole apparatus is mounted on a trailer chassis which is adapted to be towed by a vehicle to a position on-site. This form of apparatus, however, is generally only able to handle relatively small logs.

SUMMARY OF THE INVENTION

It is an object of the present invention to provide an improved construction of portable timber milling apparatus which overcomes the disadvantages of the known types of apparatus.

A still further object of the present invention is to provide improved portable timber milling apparatus which is extremely convenient to use and can be operated by a minimum number of operators.

A still further object of the present invention is to provide improved portable timber milling apparatus which can be positioned at any suitable site and which can continuously cut logs into timber lengths of any desired section.

A still further object of the present invention is to provide improved portable timber milling apparatus which is robust in construction and avoids problems associated with the use of gear box drive mechanisms, hydraulic pumps motors and lines and other similar apparatus for driving the two circular saw blades.

According to one aspect of the invention there is provided portable timber milling apparatus comprising: a mobile, wheeled platform, four posts extending vertically upwardly from the platform and defining the corners of a rectangle, a pair of substantially parallel beam support members extending between pairs of vertical posts, elevating means associated with each post for raising and lowering the beam support members, a beam mounted on and extending between the beam support members, said beam being movable along the beam support members, carriage means mounted for movement along said beam and means for mounting two circular saw blades on said carriage, one of said blades being mounted in a substantially horizontal plane and the other being mounted in a substantially vertical plane, and electric drive and control means for said circular saw blades and for driving and controlling the movement of the carriage along said beam, the beam along said beam support members and said beam support members relative to the vertical posts.

In order that the objects and advantages of the invention are more fully understood, one embodiment thereof will now be described with reference to the accompanying drawings wherein:

FIG. 1 is a side elevational view of a timber mill made according to the present invention, FIG. 2 is a plan view of the mill of FIG. 1, FIG. 3 is a sectional end elevational view taken along the line 3—3 of FIG. 2, FIG. 4 is a perspective view of one end of the beam showing the traverse control, the carriage and the longitudinal drive, FIG. 5 is a more detailed view of the traverse control, and FIG. 6 is a front view of the operator's control console.

DESCRIPTION OF THE PREFERRED EMBODIMENT

Figure 1:
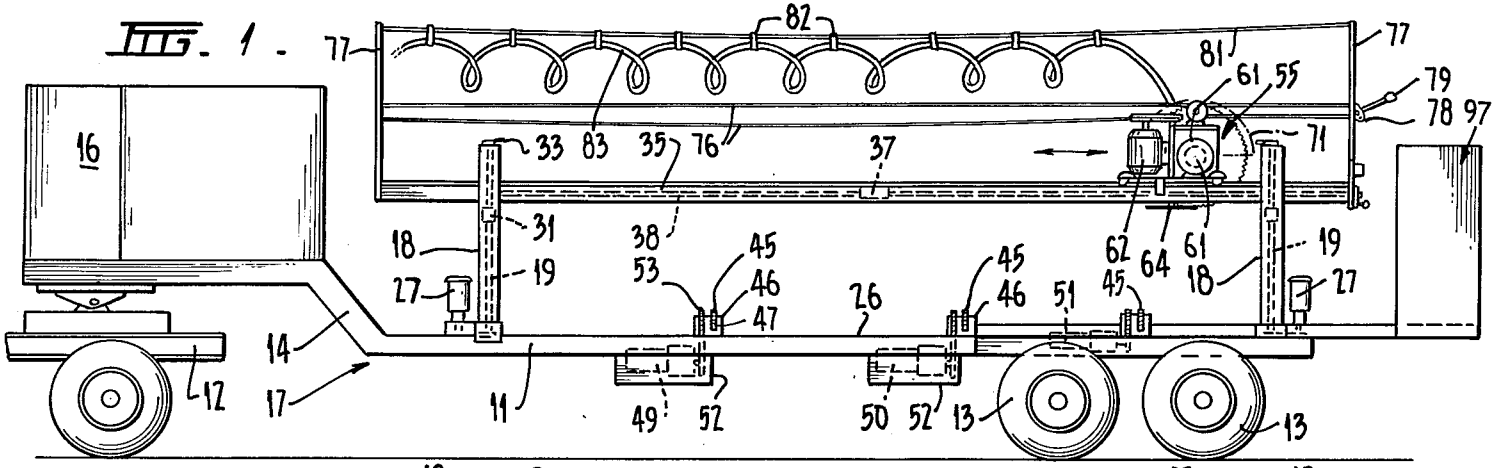
Figure 2:
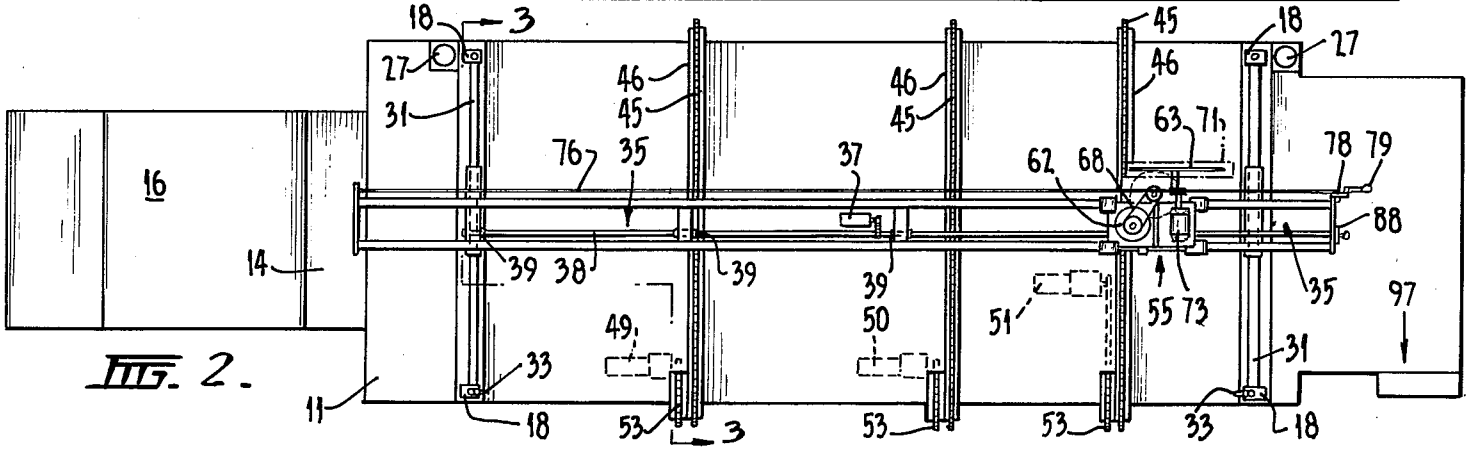

Referring to the drawings, and initially to FIG. 1 thereof, the milling apparatus of the invention as illustrated therein includes a platform 11 which is supported at its front end by a prime mover or a set of articulated trailer wheels 12. The rear end of the platform 11 is supported by two wheel sets 13.

A Diesel engine driven alternator 16 is mounted on a front end 17 of the platform 11. The alternator of this embodiment has a rating of 52 KVA, although the size of the alternator can naturally be varied in accordance with the power requirements of the milling apparatus to be driven. The output from the alternator is fed to a distribution board which is located on one side of the alternator housing. The distribution board contains the motor protection circuit breakers and overload relays for each of the electric motors used in the milling apparatus.

On the main platform section, four posts 18 extend vertically from the platform 11, the front pair of posts being spaced from the rear pair of posts a distance of approximately 20 feet. The posts are mounted adjacent the side edges of the platform and are each approximately 5 feet high. It will be appreciated that the height of the posts may be increased if desired to enable the apparatus to accommodate logs of diameters up to 8 to 10 feet.

Figure 3:
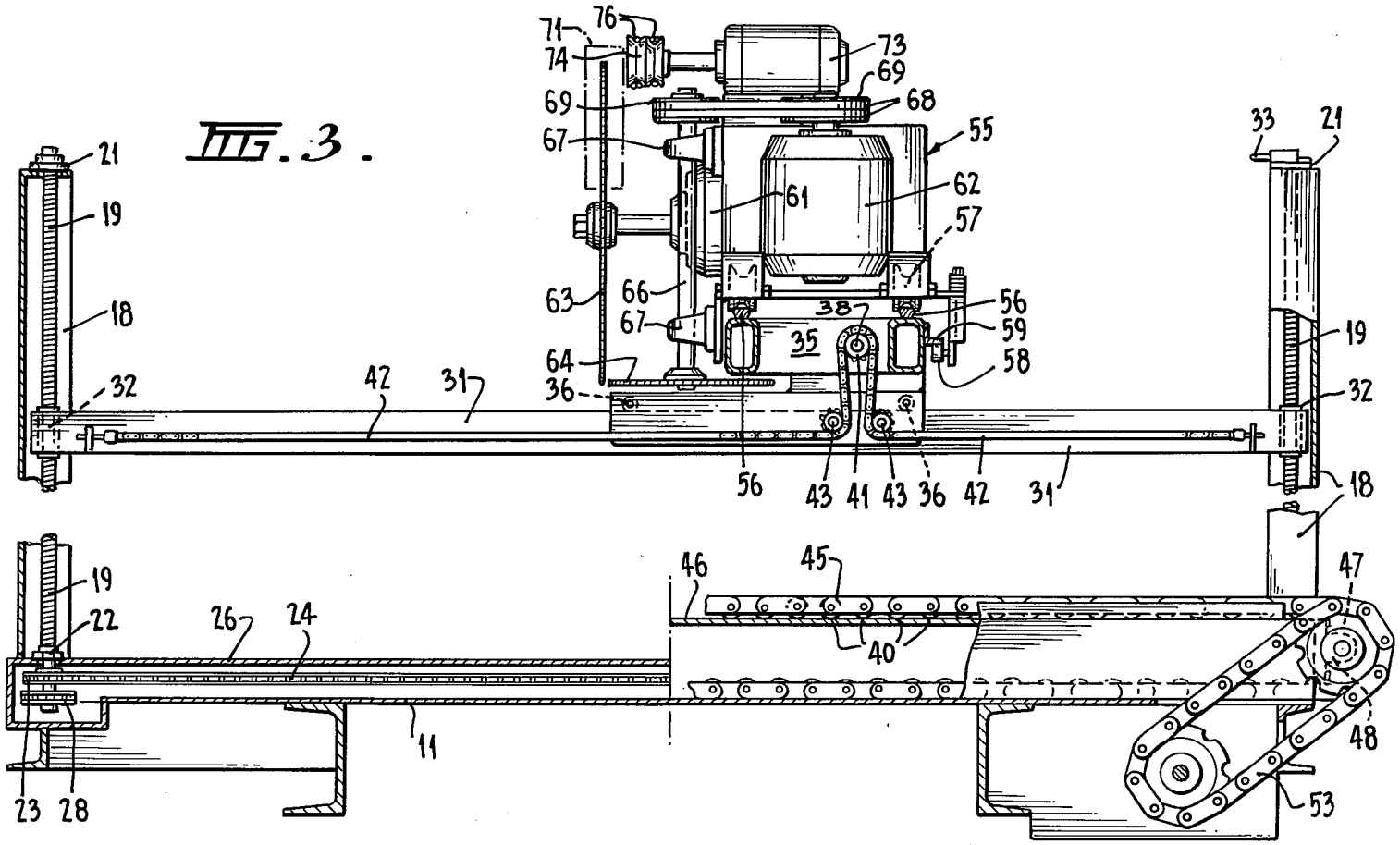

As more particularly shown in FIG. 3, each post 18 contains a vertically extending screw 19 which is mounted in bearings 21 and 22 at each end thereof. The lower end of each screw 19 is fitted with a chain sprocket 23 and the screws of each pair of posts 18 - that is the screws of the front pair of posts and the screws of the rear pair of posts - are interconnected by a driving chain 24 which extends across and underneath the surface 26 of the platform 11. An electric motor 27 is mounted adjacent one of each pair of posts 18 and is drivingly connected to the adjacent screw 19 by a further driving chain 28. In the present embodiment, the electric motor 27 is a two horse power motor driving through a reduction gear box.

A beam supporting member 31 extends between, and is supported by the screw 19 of each pair. The beam supporting member 31 carries at each end nuts 32 engaged with the appropriate screws 19 so that the member 31 is raised and lowered on rotation of the screws 19. Limit switches 33 are provided at the top and bottom of one post 18 of each pair to prevent over-travel of the beam supporting member 31 during raising or lowering thereof.

The beam supporting members 31 carrying the main longitudinally extending beam 35 which is mounted for transverse movement along the members 31 on rollers 36. The beam 35 is driven transversely by an electric tranverse motor 37 mounted substantially centrally of the beam 35. The traverse motor 27 is a onethird horse power motor which drives a longitudinally extending shaft 38 which passes through bearings 39 in the beam 35 and which terminates at sprockets 41 adjacent each beam supporting member 31. A chain 42 extends along each member 31 and passes around idler sprockets 43 and around the driving sprockets 41. The ends of the chain 42 are fixed adjacent each end of each supporting member 31, with one of the fixing means allowing adjustment of the tension of the chain 42. It will be seen that rotation of the transverse drive shaft 38 causes the beam 35 to be traversed across the supporting members 31. Suitable limit switches (not shown) are provided to prevent over-travel of the beam 35 across the members 31.

Three traverse chains 45 are spaced along the platform 11 and are mounted on guides 46 for movement across and underneath the platform surface 26. Each traverse chain 45 extends between sprockets 47 mounted in bearings 48 on each side of the platform 11. The traverse chains 45 are each independantly driven by associated electric drive motors 49, 50 and 51 located beneath the platform 11 in appropriate motor housings 52, and connected to the associated traverse chain 45 by a driving chain 53.

Each traverse chain 45 is a roller chain having rollers 40 on the chain link connecting pins. The roller 40 engage with the guide surface 46 and support the links above the guide surface thereby reducing the resistance to movement of the chain 45 during movement across the guide. The traverse chains 45 are adapted to support a log to be sawn for traverse movement across the platform.

Figures 4, 5, 6:
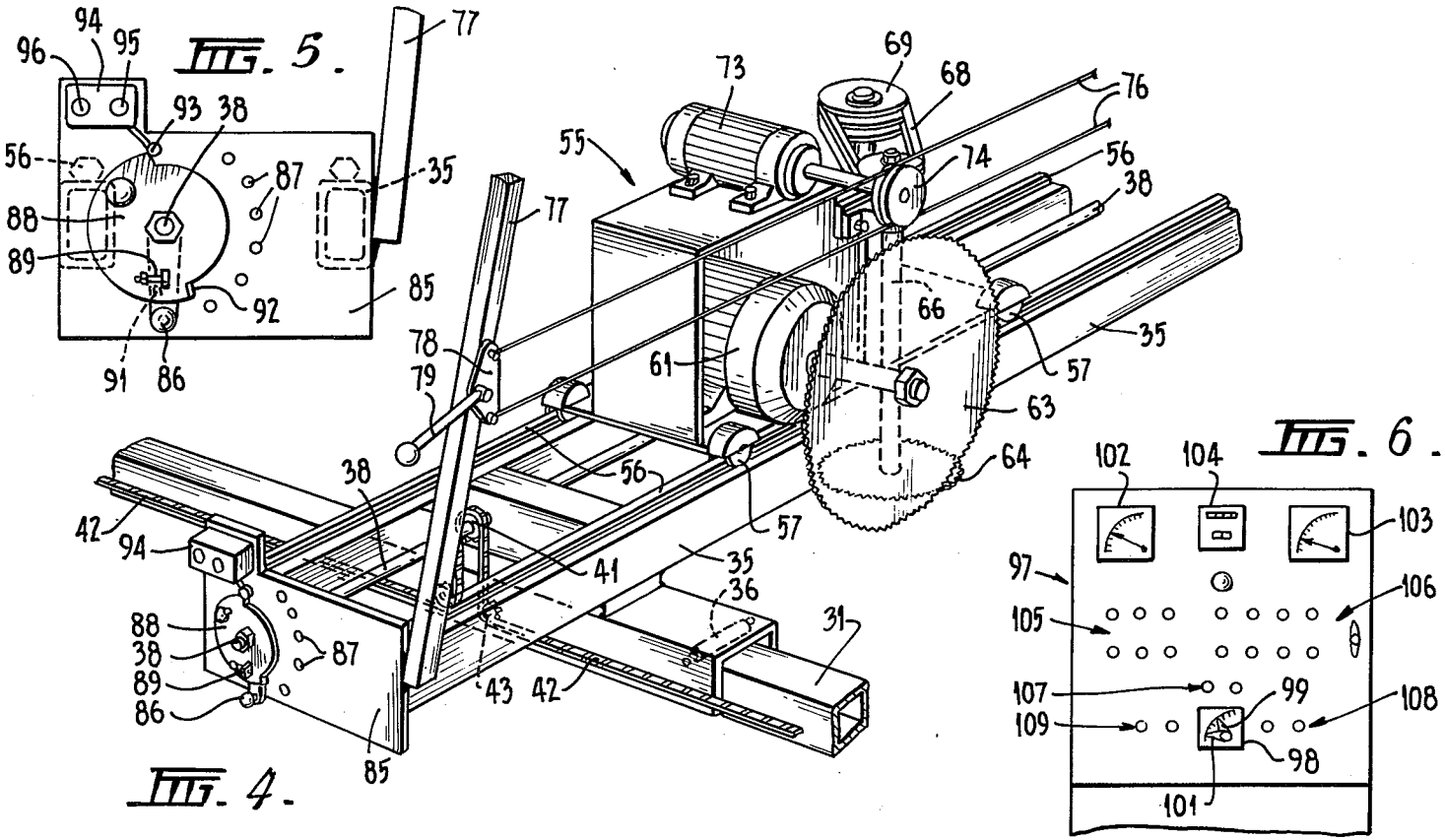

The longitudinally extending beam 35 carries a wheeled carriage 55, which is more particularly illustrated in FIGS. 3 and 4. The beam 35 is provided with a pair of rails 56 and the carriage is fitted with two pair of double flanged wheels 57 which engage over the rails 56. One wheel 57 of each pair is formed to accurately fit the associated rail 56 to form an accurate guide for the carriage while the other wheel 57 of each pair is provided with a small clearance to allow carriage movement on the rails without varying the saw settings. Each carriage wheel 57 is independantly adjustable to enable the carriage to be accurately leveled relative to the beam.

A spring loaded guide wheel 58 is mounted on one side of the carriage to engage under a flange 59 on the beam 35 to prevent the carriage lifting off the rails in the event of the saw or the wheels striking an obstruction.

The carriage 55 carries two saw motors 61 and 62, the output shafts of which extend substantially at right angles to each other. The saw motor 61 directly drives the top, vertically extending saw blade 63 which is 30 inches in diameter. The bottom saw motor 62 drives the bottom saw blade 64 through a counter shaft 66 mounted in bearings 67 on the carriage 55. The counter shaft 66 is driven through a set of V-belts 68 which engage over appropriate pulleys 69 on the motor shaft and counter shaft.

In practice, the bottom saw motor 62 and counter shaft 66 are adjusted so that the bottom saw blade 64 rotates in a plane which is at an angle of approximately 2 degrees away from the perpendicular to the plane of the top saw blade 63. This small angle away from the perpendicular provides a clearance for the saw blade during movement of the carriage along the top of a log being sawn.

A cover 71 is provided over the top saw blade 63, the cover 71 having a tangential opening in the top thereof for exiting saw dust produced by the saw blades.

A carriage driving motor 73 is also mounted on the carriage 55 the driving motor 73 is provided with a double pulley around which is wound two driving cables 76. The driving cables 76 are wound around the pulley in opposite directions and the ends of the cables 76 are supported on posts 77 extending upwardly from each end of the beam 35. At the rear end of the beam 35 the cables are attached to a pivoted plate 78 having a handle 79 extending therefrom. Movement of the handle in one direction tensions one of the driving cables 76 causing it to frictionally engage the pulley 74 on the carriage driving motor 73. The carriage is then driven by that tensioned cable and driving motor 73 in one direction along the beam 35. Movement of the handle 79 in the opposite direction tensions the other of the driving cables 76 to drive the carriage in the opposite direction.

The post 77 also carry a cable support wire 81. Hangers 82 slidably mounted on the wire 81 support the electrical cables 83 supplying power to the electric motors 61, 62 and 73 on the carriage.

In order that the mill may be set to continuously cut timber of a predetermined size without the necessity for manually setting the saw prior to each cut, control means are provided for the traverse motor 37 and the two screw motors 27 to control their operation to move the carriage and the beam selected predetermined amounts. FIG. 5 illustrates the traverse motor control which is positioned on the rear end of the beam 35. The control comprises a gauging handle 86 rotable about the axis of the longitudinally extending traverse shaft 38. A spring loaded pin (not shown) is adapted to engage in one of the gauging holes 87 in the end plate 85. The gauging holes 87 are arcuately spaced a distance corresponding to the desired traverse distance.

A control handle 88 engages over the end of the shaft 38 and is frictionally driven thereby. The control handle is provided with an adjustable shoulder 89 adapted to contact a stop 91 on the gauging handle 86. The control handle 88 also is provided with a contact lug 92 adapted to engage the control switch 93 extending from the push button switch box 94. A further control switch is provided on the beam 35 adjacent the rear end thereof and operates to prevent energizing of the traverse motor 37 unless the carriage is at the rear of the beam 35.

The traverse gauging operates as follows:

The gauging handle 86 is located with the spring loaded pin engaging one of the gauging holes which corresponds to the distance desired for each traverse of the beam 35. The control handle 88 is moved relative to the end of the shaft 38 until the adjustable shoulder 89 engages with the stop 91 on the gauging handle. When the carriage is at the rear end of the beam, the push botton 95 of the push button switch box 94 is actuated to energize the traverse motor 37. The motor continues to operate the rotate the shaft 38 thereby traversing the beam along the beam supporting members 31. Rotation of the shaft 38 causes the control handle to rotate therewith until it contacts the control switch 93 which deenergizes the traverse motor 37. The arcuate movement of the control handle corresponds with the linear movement of the beam along the beam support members.

The other push button switch 96 on the switch box 94 is operable to reverse the traverse motor drive to move the beam 35 in the opposite direction. Gauging of the reverse motion is not possible.

FIG. 6 of the drawings illustrates the face of the operator's control panel 97 which is mounted at the rear of the platform 11. The control panel includes an ameter 102 and a voltmeter 103 for monitoring the output of the alternator. An hour meter 104 indicates the hours of operation of the apparatus.

The control panel 97 also has an array of push button switches for controlling various drive motors both individually and in groups. The push buttons, generally indicated at 105, control the screw drive motors both individually and simultaneously. The push buttons generally indicated at 106 control the traverse drive motors 49, 50 and 51 both individually and simultaneously. Start and stop buttons 107 are provided for the carriage drive motor, buttons 107 are provided for the top saw and buttons 108 are provided for the bottom saw. The control panel 97 also includes a timer 98 used for automatic gauging the downward movement of the beam. The timer is an electric motor driven timer which is calibrated in inches. The timer 98 includes an indicator 99 which is set on the desired distance through which the beam is to travel downwardly. When the "down" push button is actuated both the screw driving motors are energized to drive the screws in a direction to lower the beam. At the same time, the timer 98 operates for the period of time corresponding to the setting of the indicator 99. A second, motor driven indicator 101 indicates the lapsed time the motors have been operating. When the motor driven indicator reaches zero both motors stop automatically. Release of the "down" push button during the operating of the timer will also stop both motors. The timer automatically resets the motor driven indicator when it has reached zero and the push button is disengaged.

In operation of the apparatus of the invention, it is preferred that a trench be dug with a bull dozer or the like and the platform be positioned in the trench substantially level with the surface of the ground. Alternatively, a bull dozer may be used to build up the ground on each side of the trailer to enable logs to be conveniently positioned on the platform 11.

A log, which is to be sawn into posts or the like, is moved onto the traversing chains 45 by the usual log moving apparatus, or bull dozer, or the like located at a timber felling site. Once the log is located on the traversing chains 45 the chains may be driven either together or independantly to position the log substantially centrally on the platform and aligned with the beam. Suitable wedges are inserted between the log and the traverse chain or the platform to prevent rolling of the log.

The embodiment of the present invention is of a size to handle logs up to 20 feet long and 4 feet 6 inches in diameter. The beam, which is raised to its highest extent, is positioned over the log and the carriage is moved so that the two saw blades can cut a flitch from the top of the log. The carriage is driven from the rear of the platform towards the front during the cutting stroke. The carriage is then reversed along the beam before the beam is positioned for the next cut. When the carriage reaches the rear end of the beam the beam is traversed a suitable, predetermined distance for the next cut. When the top of the log has been removed, the beam is traversed to the opposite side of the log and is lowered a predetermined distance for the next series of cuts. The distances moved both vertically and horizontally determine the timber sizes which may be cut from the log.

It will be seen that the utilization of electrical drive and control apparatus provides a high degree of control and accuracy for milling operations.

I claim:

1. Timber milling apparatus comprising a mobile platform; four posts extending upwardly from said platform; a pair of substantially parallel beam support members extending between pairs of posts; elevating means associated with each post for raising and lowering the beam support members; a beam mounted on the beam support members, and extending substantially longitudinally of the platform, said beam including means enabling the beam to move along the support members; carriage means mounted for movement along said beam; two circular saw blades carried by said carriage means, one of which is substantially parallel to the platform and the other of which is substantially perpendicular thereto, and electric drive and control means for driving said circular saw blades and for driving and controlling the carriage along said beam, the beam along the beam support members and the beam support members relative to the posts; said beam being mounted on rollers for traverse movement along each beam support member, said electric drive and control means including reversible traverse drive means selectively driving the beam towards one side or the other of the platform, said drive means having an electric traverse motor, a traverse drive shaft extending longitudinally of the beam and mounted in bearings on the beam, a chain sprocket mounted on the shaft adjacent each end thereof, a pair of idler sprockets associated with each chain sprocket, and a traversely extending chain fixed at each end thereof to opposite ends of each beam support member, each chain engaging with the associated idler and chain sprockets, and beam traverse control means for controlling said reversible traverse drive means and having a control handle frictionally mounted on one end of the traverse drive shaft and rotatable relative thereto, a gauging handle mounted co-axial with the control handle, spring biased pin means on the gauging handle for selectively engaging one of a series of gauging holes in one end of the beam which correspond to selectable beam traverse distances, an electric switch, switch engaging means on the control handle, gauging handle stop means on the control handle engagable with a shoulder on the gauging handle, and traverse motor switch means for energizing the traverse motor to rotate the traverse drive shaft thereby rotating the control handle from a position engaging the gauging handle shoulder to a position activating the electric switch to deenergize the traverse motor.

2. Apparatus according to claim 1 wherein the elevating means includes a threaded screw associated with a nut at each end of the beam support member, and an endless chain interconnecting sprockets on the bottom of each screw of each pair of posts, said electric drive and control means including motor drive means operable to drive the screws of each pair of posts.

3. Apparatus according to claim 1 including limit switch means on the beam operable to prevent energization of the traverse drive motor when the carriage is spaced more than a predetermined distance from the rear end of the beam.

4. Apparatus according to claim 1 wherein the beam includes two parallel rails and the carriage means has two pairs of double flanged wheels engaging with the rails to accurately guide the carriage along the beam, the carriage means further including a guide wheel engaging beneath a flange on the beam preventing the carriage means lifting from the rails.

5. Apparatus according to claim 1 wherein the electric drive and control means for driving said circular saw blades includes first electric motor means mounted on the carriage with its shaft extending laterally and substantially parallel with the platform to directly drive the said other of said circular saw blades, second electric motor means mounted adjacent the first motor means and having its output shaft extending upwardly substantially at right angles to the shaft of the first motor means, a counter-shaft mounted in bearings on the carriage means with its axis substantially parallel to the axis of the second motor output shaft, pulley means on the second motor output shaft and the counter-shaft, and belt means engaging the pulley means, the counter-shaft directly driving said one of said circular saw blades.

6. Apparatus according to claim 1 wherein the electric drive and control means for controlling the beam support members relative to the posts includes elevating electric motor drive means for driving the elevating means, an electric timing means including switching means for de-energizing the drive means after a predetermined and pre-set elasped time, and control switch means operable to simultaneously energize the timing means and the drive means.

7. Apparatus according to claim 1 and including log traversing means for moving a log to be sawn traversely on said platform, said log traversing means including at least two log traversing chain means extending across the platform, traverse chain sprocket means on each side of the platform about which each traverse chain engages, guide means on the platform guiding each chain means, electric drive means for each chain means, and electric control means for each electric drive means.

8. Apparatus according to claim 7 wherein each log traversing chain means comprises a roller chain having rollers engaged on each chain link connecting pin, the surface of the rollers extending beyond one side of the chain to engage the guide means and support the chain thereon.

* * * * *